United States Patent [19]

Finley et al.

[11] Patent Number: 4,698,067

[45] Date of Patent: Oct. 6, 1987

[54] FORMCOKE HAVING MODIFIED BITUMINOUS BINDER

[75] Inventors: Joseph H. Finley, Metuchen, N.J.; Richard R. Severns; Robert M. Zakotnik, both of Kemmerer, Wyo.

[73] Assignee: FMC Corporation, Philadelphia, Pa.

[21] Appl. No.: 932,755

[22] Filed: Nov. 19, 1986

Related U.S. Application Data

[63] Continuation-in-part of Ser. No. 747,636, Jun. 24, 1985, abandoned.

[51] Int. Cl.[4] ..... C10L 5/12; C10L 5/14

[52] U.S. Cl. ..... 44/15 B; 44/15 C; 44/16 R

[58] Field of Search ..... 44/15 B, 15 C, 16 R

[56] References Cited

U.S. PATENT DOCUMENTS

| | | | |
|---|---|---|---|
| 719,830 | 2/1903 | Meade | 44/15 B |
| 720,600 | 2/1903 | Morrow | 44/15 B |
| 990,348 | 4/1911 | Ellis | 44/16 R |
| 1,507,674 | 9/1924 | Nagel | 44/16 R |
| 1,507,676 | 9/1924 | Nagel | 44/16 R |
| 1,507,678 | 9/1924 | Nagel | 44/16 R |
| 1,590,706 | 6/1926 | Spencer | 44/16 R |
| 2,040,609 | 5/1936 | Holz | 44/15 |
| 2,314,641 | 3/1943 | Wolf | 202/34 |
| 3,140,241 | 7/1964 | Work et al. | 202/26 |
| 3,140,242 | 7/1964 | Work et al. | 202/26 |
| 3,403,989 | 10/1968 | Blake et al. | 44/23 |
| 4,008,053 | 2/1977 | Brenneman et al. | 44/1 D |
| 4,152,119 | 5/1979 | Schulz | 44/1 D |
| 4,602,917 | 7/1986 | Finley et al. | 44/15 B |

FOREIGN PATENT DOCUMENTS

| | | | |
|---|---|---|---|
| 229905 | 3/1925 | United Kingdom | 44/16 R |

*Primary Examiner*—Carl F. Dees

*Attorney, Agent, or Firm*—Robert D. Jackson; Frank Ianno; Eugene G. Seems

[57] ABSTRACT

Formcoke is produced by introducing feedstocks of calcined coal particles, bituminous binder, an aqueous carbohydrate and phosphoric acid into a mixing zone. The resulting mixture is compacted into shapes, such as briquettes, which are then cured in an oxygen-containing atmosphere and optionally heated to coking temperatures.

12 Claims, No Drawings

FORMCOKE HAVING MODIFIED BITUMINOUS BINDER

This is a continuation-in-part of application Ser. No. 747,636, filed June 24, 1985 now abandoned.

This invention relates to formcoke. More particularly, the invention pertains to improvements in supplemental binders for use as an adjunct to the bituminous binder in the manufacture of formcoke.

Formcoke is well known in the fuel and in the metallurgical arts where it is widely employed as a reductant in the smelting of ores. Although various types have been described, essentially all formcoke is obtained by compressing a mixture of particulate carbon and a binder into appropriate shapes, a common configuration being that of pillow briquettes. Depending on their end use, such briquettes may require subsequent treatment to increase hardness and durability. For instance, metallurgical grade formcoke is obtained by heating, first at curing and then at coking temperatures, compacted shapes composed of coal derived particulate carbon and a bituminous binder.

A metallurgical grade of formcoke of exceptionally high quality and which is manufactured commercially, is described in U.S. Pat. Nos. 3,140,241 and 3,140,242 to Work et al. In producing this formcoke, coal particles are subjected to three sequential heat treatments to give reactive calcined coal particles, tar vapors and gases. The tar vapors are condensed and the resulting tar oxidized and dehydrated to produce pitch for use as a binder. This is mixed with the calcined coal particles and pressed into briquettes which are heated in an oxygen-containing atmosphere to effect polymerization of binder and coal char and give hardened briquettes. These can be converted to the final formcoke product by heating at coking temperatures in a nonreactive atmosphere.

In a typical operation of producing formcoke according to the Work et al patents, bituminous coal, including noncoking coals, of a particle size less than 6 mesh (U.S. Standard Sieve Series) and preferably less than 16 mesh with the average particle size in the range of from 40 to 60 mesh, is heated in the presence of oxygen, which may be derived from the coal itself in the case of the so-called high oxygen-containing coals, that is, coals having an excess of 15% by weight of oxygen, to a temperature high enough to drive off substantially all moisture but below that at which substantial amounts of tar-forming vapors evolve. Thereafter, the coal particles from this heat treatment are heated to a higher temperature at which tar-forming vapors are evolved and for a time interval sufficient to effect polymerization of the heated coal particles and evolution therefrom of substantially all of the tar-forming vapors to produce a char of markedly lower volatile combustible material content than the parent coal and substantially free of tar-forming vapors. This char is heated to a still higher temperature to produce the calcined char particles for blending with the bituminous binder. Calcining is typically conducted at about 760° C. to 982° C. for about 20 to 30 minutes.

The calcined char is mixed with the binder in the proportion of from 75% to 90% calcined char to 25% to 10% binder. These percentages are based on the weight of the total mix. Preferred binders are coal tar pitch or pitches produced by condensation of tars from the gases evolved during the carbonization and the subsequent dehydration, stripping, and/or oxidation of the resultant tars to produce pitches having a softening point of from 38° C. to 107° C. (ASTM Ring and Ball).

The blend of calcined char and binder is compressed to produce green briquettes which are then cured in an atmosphere containing oxygen to bring about copolymerization of the binder and the char so as to make the briquettes strong and infusible. Typically, curing is effected at about 195° C. to 250° C. for about one to two hours. The cured briquettes are coked to produce briquettes suitable for metallurgical purposes. Typically, coking is conducted at about 800° C. to 900° C. for about 20 minutes. The briquettes thus produced, when observed even under a relatively low power magnification, are of uniform composition, that is, as a general rule the carbon derived from the calcined char and that derived from the bituminous binder are indistinguishable.

A more detailed description of the aforesaid process of producing formcoke is given in the cited U.S. Pat. Nos. 3,140,241 and 3,140,242, the disclosure of which is incorporated herein by reference.

When producing briquettes from bituminous coals having insufficient volatile matter to furnish enough tar to supply the binder requirements for the process, a supplemental source of a suitable binder must be used. Many bituminous binders, including paraffinic asphalts and some asphalts ordinarily used for making green briquettes, when used alone or when blended with the pitch binder derived from the tar produced in the carbonization stage of the process, are unsatisfactory because they do not polymerize (or copolymerize) sufficiently well in the oxidative curing step to harden the green briquette and cause it to become infusible. In some cases, these unsatisfactory binders solidify during oxidative curing but they do not bond the char particles together sufficiently well to give a strong cured briquette. In either case, the result is cured briquettes having low crushing strength which on coking are unsatisfactory for metallurgical purposes.

Generally speaking, it has been the conventional thinking in the art that supplemental binders, used for preparing formcoke, must be compatible with the main bituminous binder. See, for instance, U.S. Pat. No. 3,403,989 which discloses certain petroleum derived asphalts that are compatible with the bituminous binder used in producing the formcoke of the aforecited Work et al patents. Various coal tar pitches obtained as byproducts in the manufacture of oven coke are also compatible with bituminous binders but these are quite costly owing to the marked rise in the price of coal tar products in recent years. Even petroleum asphalts, at least of the type having the requisite compatibility, are not inexpensive.

Manifestly, the economics of formcoke production stand to benefit from the development of a low cost binder which can be used as a supplement or extender for bituminous binders.

The discovery has now been made that supplementary binders which are not compatible with bituminous binders can be utilized in preparing formcoke and the provision of such formcoke and a method of producing it constitutes the principal object and purpose of the invention. Other objects and purposes of the invention will be apparent from the ensuing description.

The objects aforesaid can be realized in accordance with the invention by introducing a supplementary binder described hereinafter into the mixing zone of a formcoke plant separately from the bituminous binder feed stream. The supplementary feed stream requires no substantive changes in either the design or operation of the formcoke plant. Basically, the supplementary binder feed unit consists of a suitable reservoir for containing the binder material which is conveyed therefrom as a liquid via a feed line to the mixing zone. The physical layout of the supplementary binder feed system is simple to operate and can be installed as a low cost add-on item to an existing formcoke plant. The material from the mixer is conveyed to the compacting zone where it is compressed into green formcoke shapes which can be cured and coked in the normal manner. There is no substantial diminution in strength or durability of the cured or coked shapes, their properties being essentially identical to the specifications of formcoke as produced heretofore.

The supplemental binder system of the invention consists of phosphoric acid and a carbohydrate in an aqueous liquid medium. These components can be premixed prior to adding them to the mixing zone of the formcoke plant or they may be added as separate feed streams.

In carrying out the invention, formcoke is prepared following generally the known procedure by introducing particulate carbon and bituminous binder into a mixing zone except that provision is made for adding a separate feed stream of the supplementary binder. Broadly, the process comprises (1) introducing into a mixing zone on a weight basis from about 75% to about 90% of particulate carbon and as an overall binder therefor from about 10% to about 25% of a mixture containing from about 4% to about 23% of a formcoke bituminous binder and as a supplementary binder from about 14% to about 1.0% of a combined quantity and in a weight ratio of about 9 to 1 of an aqueous carbohydrate having a concentration by weight of about 50% to about 80% and phosphoric acid having a concentration by weight of about 50% to about 100%, the water content of the resulting mixture not exceeding about 15% by weight, (2) compressing the mixture from the mixing zone into compacted green shapes and (3) curing the compacted green shapes in an oxygen-containing atmosphere. Thus, a green briquette containing 25% overall binder will contain from about 22.5% to about 11.0% bituminous binder and from about 2.5% to about 14% supplementary binder. On the other hand, a green briquette containing 10% overall binder will contain from about 4.4% to about 9.0% bituminous binder and from about 1.0% to about 5.6% supplementary binder. Where metallurgical formcoke is being produced, the cured shapes are coked in a nonreactive atmosphere to develop maximum crushing strength.

It is believed that the use of the carbohydrate/phosphoric acid supplementary binder herein is generally applicable to formcoke made from particulate carbons and bituminous binders by the known procedures. It is, however, desirably employed as an adjunct to the commercial manufacture of high quality metallurgical formcoke, particularly the formcoke and process described in the Work et al patents. By substituting the supplemental binder of the invention for the previously used expensive compatible asphalts and pitches to make up for in-house binder shortage, the economics of formcoke production are considerably improved. When the invention is practiced in combination with the manufacture of formcoke in accordance with the Work et al patents, that process is followed but modified whereby the aqueous carbohydrate/phosphoric acid is introduced into the mixer simultaneously with but separately from the calcined coal char and bituminous binder. The aqueous carbohydrate and phosphoric acid can be combined prior to adding to the mixer or they can be introduced therein as separate feed streams, preferably the latter.

The percentage of tar and supplemental binder required to produce formcoke briquettes of a given strength depends on various factors. Among these may be mentioned particle size distribution, surface area and porosity of the particulate carbon and its reactivity, that is, its capacity to copolymerize with the binder under curing conditions. The calcined coal char used in the manufacture of formcoke by the Work et al process exhibits such reactivity to a marked degree.

As an illustration of the effect of particle size, formcoke pellets exhibited marked reduction in crushing strength as the percentage of 100 mesh carbon fines was increased at a given binder percentage.

The temperature at which the particulate carbon and binders are blended also influence the strength of formcoke. Temperature affects binder viscosity and hence the extent to which it is absorbed in the fine pore structure of the carbon particles. If an excessively large percentage is absorbed, little binder remains to coat the carbon particles with the result that they do not adhere sufficiently to one another and thus resist compaction under briquetting pressures. Generally speaking, satisfactory grades of formcoke can be obtained at briquetting temperatures in the range of about 75° C. to 100° C. Preferred briquetting temperatures are in the 90° C. to 100° C. range.

In a typical operation, bituminous material and the aqueous carbohydrate and phosphoric acid are metered from separate orifices situated approximately 2–3 inches apart into the center of the mixer into which the carbonaceous solids are continuously fed. The solids feed enters the mixer at temperatures well above the normal softening point of the bituminous binder (54° C. to 66° C.) as determined by ASTM Ring and Ball test. Binders and solid are blended at temperatures in the neighborhood of 75° C. to 100° C., preferably 90° C. to 100° C.

The carbohydrate component of the herein supplemental binder system can be a starch or a sugar, the latter being preferred, and these include mono-, di-, and trisaccharides. Especially preferred because of their low cost and ready availability are the waste products of sugar refining, and in this connection nonfood grade beet sugar molasses is low in cost and gives excellent results. Nonfood grade molasses is a by-product recovered in the manufacture of sugar from sugar beets. It is a dark, viscous aqueous liquid having a solids content by weight of from about 70% to about 80%.

The phosphoric acid component is employed at a concentration by weight of about 50% to about 100%, preferably at about 70%.

The weight ratio of aqueous carbohydrate to phosphoric acid can vary but a weight ratio of about 9 to 1 has been found to be highly satisfactory.

CRUSHING STRENGTH PROCEDURE

Crushing strength values afford meaningful strength comparisons of formcoke specimens. In determining crushing strength, a cylindrical pellet of formcoke is commonly utilized for conducting laboratory tests and collecting experimental data. The pellets should be prepared from a common stock of particulate carbon in order to eliminate variations due to sizing, porosity or surface area differences. Crushing strength is ascertained by applying pressure to each of the parallel flat surfaces of the cylindrical pellets of formcoke at a rate of 0.05 inch per minute in an Instron Universal Tester. The pressure at which the pellet fractures is recorded and converted to pounds/inch$^2$ (psi), based on measurement of the flat surface area.

Reference is now made to the following non-limiting examples.

PROCEDURE FOR PREPARING EXAMPLES

Calcined coal char (calcinate), obtained by the procedure of U.S. Pat. Nos. 3,140,241 and 3,140,242 and having the following particle size distribution, was used in these examples.

| Sieve Size USS Series | Cumulative, % |
|---|---|
| on 8 mesh | 1.8 |
| on 18 mesh | 22.1 |
| on 30 mesh | 39.9 |
| on 50 mesh | 66.2 |
| on 100 mesh | 84.3 |
| Through 100 mesh | 15.7 |

Three hundred and fifty grams of the calcinate was warmed at 90° C. to 100° C. in an oven, and combined with a warm (80° C.) mixture of molasses and 70% phosphoric acid in a weight ratio of 9 to 1. Hot (150° C.) bituminous binder, produced by the process of the aforecited patents, was then added. The mixture was agitated for about seven minutes in a Hobart blender while maintaining the temperature at about 75° C. by means of a heating mantle. In most cases, pellets were prepared by compressing 15.0 g portions of the mixture in a prewarmed 1⅛ inch die at 6000 pounds pressure in a Carver press. This generally resulted in pellets of approximately one inch in height.

The green pellets were cured by heating them in a bed of finely divided (−4 mesh) coke at 200° C. to 230° C. for two hours in the presence of air. Coking was effected by heating the cured pellets under nitrogen (600 ml/min.) at 800° C. for 0.5 hours in a Lindberg Type 54233 tube furnace. The pellets were then cooled under nitrogen.

Crushing strength of the coke pellets was determined by means of the test procedure described aforesaid. Exemplary pellets and their crushing strength are set forth in the Table.

TABLE

Effect of Molasses-Phosphoric Acid Supplementation on Formcoke Crushing Strength

| Binder Concentration, % (wt.) Molasses-Phosphoric | | | Crushing Strength, psi | |
|---|---|---|---|---|
| Tar | Acid (70%) | Total | Values | Av. Value |
| 16.0 | 0 | 16.0 | 972<br>1027 | 1000 |
| 12.9 | 4.0 | 16.9 | 945<br>1207<br>1389<br>1583 | 1281 |
| 8.0 | 10.0 | 18.0 | 1062<br>1401 | 1232 |

As will be observed from the test data, the crushing strength of the formcoke pellets made with supplemental binder of the invention is at least equal and generally exceeds that of the pellets made with bituminous binder alone.

We claim:

1. A process for producing formcoke comprising the steps of: (1) introducing separately into a mixing zone on a weight basis from about 75% to about 90% of a particulate carbon and as an overall binder therefor from about 10% to about 25% of a mixture containing from about 4% to about 23% of a formcoke bituminous binder and as a supplementary binder from about 14% to about 1.0% of a combined quantity and in a weight ratio of about 9 to 1 of an aqueous carbohydrate having a concentration by weight of about 50% to about 80% and phosphoric acid having a concentration by weight of about 50% to about 100%, the water content of the resulting mixture not exceeding about 15% by weight (2) compressing the mixture from the mixing zone into compacted green shapes and (3) curing the compacted green shapes in an oxygen-containing atmosphere.

2. The process of claim 1 wherein the compacted shapes are pillow briquettes.

3. The process of claim 1 wherein the particulate carbon is calcined coal char.

4. The process of claim 1 wherein the carbohydrate is a sugar.

5. The process of claim 4 wherein the carbohydrate is molasses from beet sugar refining and having a solids content by weight of about 50% to 80%.

6. The process of claim 1 wherein the aqueous carbohydrate and phosphoric acid are combined prior to introducing them into the mixing zone.

7. The process of claim 1 wherein the aqueous carbohydrate and phosphoric acid are added to the mixing zone as separate feed streams.

8. A process of producing metallurgical formcoke briquettes comprising the steps of: (1) introducing separately into a mixing zone on a weight basis from about 75% to about 90% of calcined coal char and as an overall binder therefor from about 10% to about 25% of a mixture containing from about 4% to about 23% of a formcoke bituminous binder and a supplementary binder from about 14% to about 1.0 % of a combined quantity and in a weight ratio of about 9 to 1 of molasses from beet sugar refining and about 70% by weight phosphoric acid, the water content of the resulting mixture not exceeding about 15% by weight, (2) compressing the mixture from the mixing zone into compacted green briquettes, (3) curing the green briquettes in an oxygen-containing atmosphere and (4) coking the cured briquettes by heating them to coking temperatures in a nonreactive atmosphere.

9. The process of claim 8 wherein the calcined coal char is obtained by heating coal particles below tar-forming temperatures in a first stage under oxidizing conditions; heating the oxidized coal particles in a second stage to carbonizing temperatures to effect evolution of tar-forming vapors and heating the carbonized coal particles in a third stage to calcining temperatures to give calcined coal particles of reduced volatile content and wherein the bituminous binder is derived by the dehydration, stripping and/or oxidation of the evolved tar from the carbonization aforesaid until a pitch is obtained having an ASTM Ring and Ball softening point of from 38° C. to 107° C.

10. A formcoke shape produced by the process of claim 1.

11. A formcoke shape produced by the process of claim 8.

12. A formcoke shape produced by the process of claim 9.

* * * * *